US009574328B2

(12) United States Patent
Hijikata

(10) Patent No.: US 9,574,328 B2
(45) Date of Patent: Feb. 21, 2017

(54) POWER REGENERATION DEVICE FOR WORKING MACHINE AND WORKING MACHINE

(71) Applicant: HITACHI CONSTRUCTION MACHINERY CO., LTD., Tokyo (JP)

(72) Inventor: Seiji Hijikata, Tsukuba (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 482 days.

(21) Appl. No.: 14/353,677

(22) PCT Filed: Dec. 18, 2012

(86) PCT No.: PCT/JP2012/082837

§ 371 (c)(1),
(2) Date: Apr. 23, 2014

(87) PCT Pub. No.: WO2013/099710

PCT Pub. Date: Jul. 4, 2013

(65) Prior Publication Data

US 2014/0283509 A1 Sep. 25, 2014

(30) Foreign Application Priority Data

Dec. 28, 2011 (JP) ..... 2011-289316

(51) Int. Cl.
*F15B 21/14* (2006.01)
*E02F 9/22* (2006.01)
(Continued)

(52) U.S. Cl.
CPC ..... *E02F 9/2217* (2013.01); *E02F 9/2075* (2013.01); *E02F 9/2091* (2013.01); *E02F 9/2285* (2013.01);
(Continued)

(58) Field of Classification Search
CPC ..... E02F 9/2217; E02F 9/2091; F15B 21/14; B66F 9/22
See application file for complete search history.

(56) References Cited

U.S. PATENT DOCUMENTS

2012/0167561 A1* 7/2012 Ono ..... B60K 6/46 60/486
2013/0213020 A1* 8/2013 Ishikawa ..... B60W 10/06 60/311
2013/0300128 A1* 11/2013 Fujishima ..... E02F 9/2217 290/1 R

FOREIGN PATENT DOCUMENTS

JP 2004-138187 A 5/2004
JP 2006-312995 A 11/2006
(Continued)

OTHER PUBLICATIONS

International Preliminary Report on Patentability received in International Application No. PCT/JP2012/082837 dated Jul. 10, 2014.

*Primary Examiner* — Thomas E Lazo
*Assistant Examiner* — Abiy Teka
(74) *Attorney, Agent, or Firm* — MATTINGLY & MALUR, PC

(57) ABSTRACT

In a lowering operation of a boom, the amount of operation of a control lever is detected by a pressure sensor and input to a controller. Based on the input operation amount, the controller obtains a target flow rate $Q_0$ of return oil discharged from a boom cylinder, calculates a deviation $\Delta Q$ between the target flow rate $Q_0$ and an actual flow rate Q obtained from an actual rotation speed N of an electric motor acquired by a rotation speed sensor, calculates a signal Sm for controlling the opening area of a proportional solenoid valve in a manner allowing hydraulic fluid to flow to a control valve in just as much as $\Delta Q$, and controls an operation pilot pressure of the control valve supplied from a
(Continued)

sub-pump in accordance with the signal Sm so that the hydraulic fluid will flow to the control valve exactly in the amount of ΔQ.

12 Claims, 7 Drawing Sheets

(51) Int. Cl.

| | |
|---|---|
| ***E02F 9/20*** | (2006.01) |
| ***F15B 11/044*** | (2006.01) |
| ***F15B 13/02*** | (2006.01) |
| ***F15B 13/044*** | (2006.01) |

(52) U.S. Cl.

CPC ..... *E02F 9/2296* (2013.01); *F15B 11/044* (2013.01); *F15B 13/022* (2013.01); *F15B 13/0442* (2013.01); *F15B 21/14* (2013.01); *F15B 2211/20515* (2013.01); *F15B 2211/353* (2013.01); *F15B 2211/355* (2013.01); *F15B 2211/611* (2013.01); *F15B 2211/6316* (2013.01); *F15B 2211/6326* (2013.01); *F15B 2211/6346* (2013.01); *F15B 2211/6355* (2013.01); *F15B 2211/665* (2013.01); *F15B 2211/6654* (2013.01); *F15B 2211/7058* (2013.01); *F15B 2211/7135* (2013.01); *F15B 2211/761* (2013.01); *F15B 2211/88* (2013.01)

(56) References Cited

FOREIGN PATENT DOCUMENTS

| | | | |
|---|---|---|---|
| JP | 2007-107616 | A | 4/2007 |
| JP | 2012-041978 | A | 3/2012 |
| JP | 2012-097844 | A | 5/2012 |
| JP | 2012-237409 | A | 12/2012 |
| JP | 2013-002540 | A | 1/2013 |
| WO | 2012/023231 | A1 | 2/2012 |

* cited by examiner

POWER REGENERATION DEVICE FOR WORKING MACHINE AND WORKING MACHINE

TECHNICAL FIELD

The present invention relates to a power regeneration device for a working machine and to a working machine. More particularly, the invention relates to a power regeneration device which is attached to a working machine equipped with hydraulic actuators for driving the working machine such as hybrid hydraulic actuators and which recovers energy by means of return oil from the actuators, as well as to a working machine furnished with such the power regeneration device.

BACKGROUND ART

In recent years, there has been an increasing demand for improving the fuel consumption of working machines such as hydraulic excavators. Various measures for meeting that demand have been proposed.

For example, there is proposed a hybrid hydraulic excavator that has an electric motor (generator) connected to a fixed displacement hydraulic motor attached to the hydraulic line (return oil hydraulic line) of the hydraulic chamber through which the return oil flows in a boom lowering operation on the bottom side of a boom cylinder (hydraulic actuators). This hybrid hydraulic excavator has the hydraulic motor driven by use of the return oil from the boom cylinder, the hydraulic motor in turn driving the electric motor. The electric energy obtained by driving the electric motor is stored into an electric storage device connected via an inverter, a chopper or the like.

As the power regeneration device for a working machine regenerating power by introducing the return oil from the boom cylinder into the fixed displacement hydraulic motor in the above-outlined manner, Patent Literature 1 describes one that branches the return oil from the boom cylinder into the power regeneration side (hydraulic motor side) and the control valve side so as to improve the operability of the hydraulic actuators.

PRIOR ART LITERATURE

Patent Literature

[PTL 1]
JP,A 2007-107616

SUMMARY OF THE INVENTION

Problems to be Solved by the Invention

In the power regeneration device that drives the hydraulic motor using the return oil from the hydraulic actuators (boom cylinder) so as to drive the electric motor to recover energy, the hydraulic motor and electric motor have a large moment of inertia each. This poses the problem of poor responsiveness when the hydraulic actuators start to move in response to an operator's operations.

In the power regeneration device described in Patent Literature 1, the return oil from the boom cylinder is branched into the power regeneration side and the control valve side. However, the problem is that since flow rate distribution to the power regeneration side and the control valve side is performed definitively in keeping with control lever operations, more return oil than is necessary is made to flow toward the control valve side, causing less energy to be recovered by the power regeneration device.

An object of the present invention is to provide a power regeneration device for the working machine which ensures responsiveness when hydraulic actuators start to move and which can maximize the energy to be recovered, as well as a working machine furnished with such the power regeneration device.

Means for Solving the Problems

In achieving the above objective, the invention described in claim 1 is a power regeneration device for a working machine equipped with a hydraulic actuator for driving a work device, a control valve for operating and controlling the hydraulic actuator, and a control lever device with a control lever for operating the control valve to activate the hydraulic actuator. The power regeneration device includes: a hydraulic motor driven by return oil from the hydraulic actuator; an electric motor connected mechanically to the hydraulic motor and driven thereby to generate electric power; an inverter which controls the rotation speed of the electric motor; and an electric storage device which stores the electric power generated by the electric motor. The return oil discharged from the hydraulic actuator is branched and distributed to the side of the control valve and that of the hydraulic motor. The power regeneration device further includes: a rotation speed detector which detects an actual rotation speed of the electric motor; an operation amount detector which detects the amount of operation of the control lever; a proportional solenoid valve which adjusts the opening area of the control valve; and a control device to which the rotation speed detected by the rotation speed detector and the operation amount detected by the operation amount detector are input. The control device obtains a target flow rate of the return oil discharged from the hydraulic actuator and a target rotation speed of the electric motor based on the operation amount to control the rotation speed of the electric motor via the inverter in a manner attaining the target rotation speed of the electric motor. The control device further obtains a deviation between the target flow rate and the actual flow rate of hydraulic fluid passing through the electric motor based on the target flow rate and on the actual rotation speed of the electric motor detected by the rotation speed detector, and controls the proportional solenoid valve based on the deviation obtained.

In the power regeneration device of the present invention structured as outlined above, when the hydraulic actuator is operated, the control device obtains the target flow rate of the return oil discharged from the hydraulic actuator and the target rotation speed of the electric motor based on the operation amount of the control lever. The control device controls the rotation speed of the electric motor via the inverter to attain the target rotation speed thus obtained. The control device further controls the proportional solenoid valve based on the deviation between the target flow rate and the actual rotation speed of the electric motor detected by the rotation speed detector. Thus when the actuator starts to move, an operating pilot pressure is input via the proportional solenoid valve into an operation spool of the control valve to control the opening area of the control valve in a manner permitting the flow therethrough of the hydraulic oil at a flow rate commensurate with an insufficient amount of the hydraulic fluid from the actuator falling short of the target flow rate because the delivery displacement of the hydraulic motor is fixed. This causes the hydraulic fluid discharged from the hydraulic actuator to flow at the target flow rate, allowing the hydraulic actuator to move smoothly in response to the operator's operations. Also, the amount of the hydraulic fluid flowing through the control valve is a minimum amount necessary for raising responsiveness; there is no need for causing any more hydraulic fluid than is necessary to flow through the control valve. This allows the efficiency of power regeneration by the power regeneration device to remain sufficiently high.

The invention described in claim 2 is a power regeneration device for a working machine according to claim 1, in which the control device includes: a target flow rate calculation unit which receives the operation amount and obtains the target flow rate based on the received operation amount; a target rotation speed calculation unit which obtains the target rotation speed from the target flow rate obtained; an electric motor command value calculation unit which obtains an inverter control signal for the inverter from the target rotation speed obtained; an actual flow rate calculation unit which receives the actual rotation speed and obtains the actual flow rate based on the received actual rotation speed; a control valve target flow rate calculation unit which obtains the deviation from the actual flow rate and the target flow rate and provides the deviation obtained as a target flow rate for the control valve; and a proportional solenoid valve command value calculation unit which obtains a control signal for the proportional solenoid valve from the control valve target flow rate obtained.

The control device possessing the above-outlined control functions obtains the target flow rate for the electric motor based on the operation amount of the control lever, performs control to have the rotation speed of the electric motor coincide with the target rotation speed obtained from the target flow rate, and controls the proportional solenoid valve based on the deviation between the target flow rate and the actual flow rate of the electric motor. The control device thus ensures the responsiveness of the hydraulic actuator to the operator's operations, keeps the hydraulic actuator activated smoothly when it start to move, and maintains high efficiency of power regeneration by not letting any more hydraulic fluid than is necessary flow to the control valve.

The invention described in claim 3 is a power regeneration device for a working machine according to claim 1, in which the control device includes: a target flow rate calculation unit which receives the operation amount and obtains the target flow rate based on the received operation amount; a target rotation speed calculation unit which obtains the target rotation speed from the target flow rate obtained; an electric motor command value calculation unit which obtains an inverter control signal for the inverter from the target rotation speed obtained; a control valve target flow rate calculation unit which receives the actual rotation speed, obtains a deviation between the target flow rate and the actual flow rate from the deviation between the target rotation speed obtained by the target rotation speed calculation unit and the actual rotation speed, and provides the deviation obtained as a target flow rate for the control valve; and a proportional solenoid valve command value calculation unit which obtains a control signal for the proportional solenoid valve from the control valve target flow rate obtained.

The control device possessing the above-outlined control functions also obtains the target flow rate for the electric motor based on the operation amount of the control lever, performs control to have the rotation speed of the electric motor coincide with the target rotation speed obtained from the target flow rate, and controls the proportional solenoid valve based on the difference between the target rotation speed and the actual rotation speed of the electric motor. The control device thus ensures the responsiveness of the hydraulic actuator to the operator's operations, keeps the hydraulic actuator activated smoothly when it start to move, and maintains high efficiency of power regeneration by not letting any more hydraulic fluid than is necessary flow to the control valve.

The invention described in claim 4 is a power regeneration device for a working machine according to any one of claims 1 through 3, further including an on-off valve which is connected in parallel with the control valve and interposed between the hydraulic pump and the hydraulic fluid supply side of the hydraulic actuator and which is switched to the opened position when the control lever of the control lever device is operated.

In the power regeneration device structured as outlined above, the flow rate of the hydraulic fluid discharged from the hydraulic actuator is controlled to be the target flow rate. Also, there is provided the on-off valve connected in parallel with the control valve between the hydraulic pump and the hydraulic pressure supply side of the hydraulic actuator. This structure allows the hydraulic fluid from the hydraulic pump to be fed to the hydraulic fluid supply side of the hydraulic actuator so that the hydraulic actuator responds better to the operator's operations. Because there is no need for making any more hydraulic fluid than is necessary flow to the control value, the power regeneration device can maintain high efficiency of power regeneration.

The invention described in claim 5 is a working machine furnished with a power regeneration device for a working machine according to any one of claims 1 through 4.

The working machine equipped with the power regeneration device of this invention ensures the responsiveness of the hydraulic actuator in response to the operator's operations, thereby keeping the hydraulic actuator activated smoothly when they start to move and maintaining high efficiency of power regeneration.

Effects of the Invention

According to the present invention, it is possible to ensure good responsiveness when the return oil from the hydraulic actuator is recovered by the power regeneration device thereby permitting highly responsive motion desired by the operator, and to recover more energy than before at the same time.

MODE FOR CARRYING OUT THE INVENTION

First Embodiment

Figure 1:
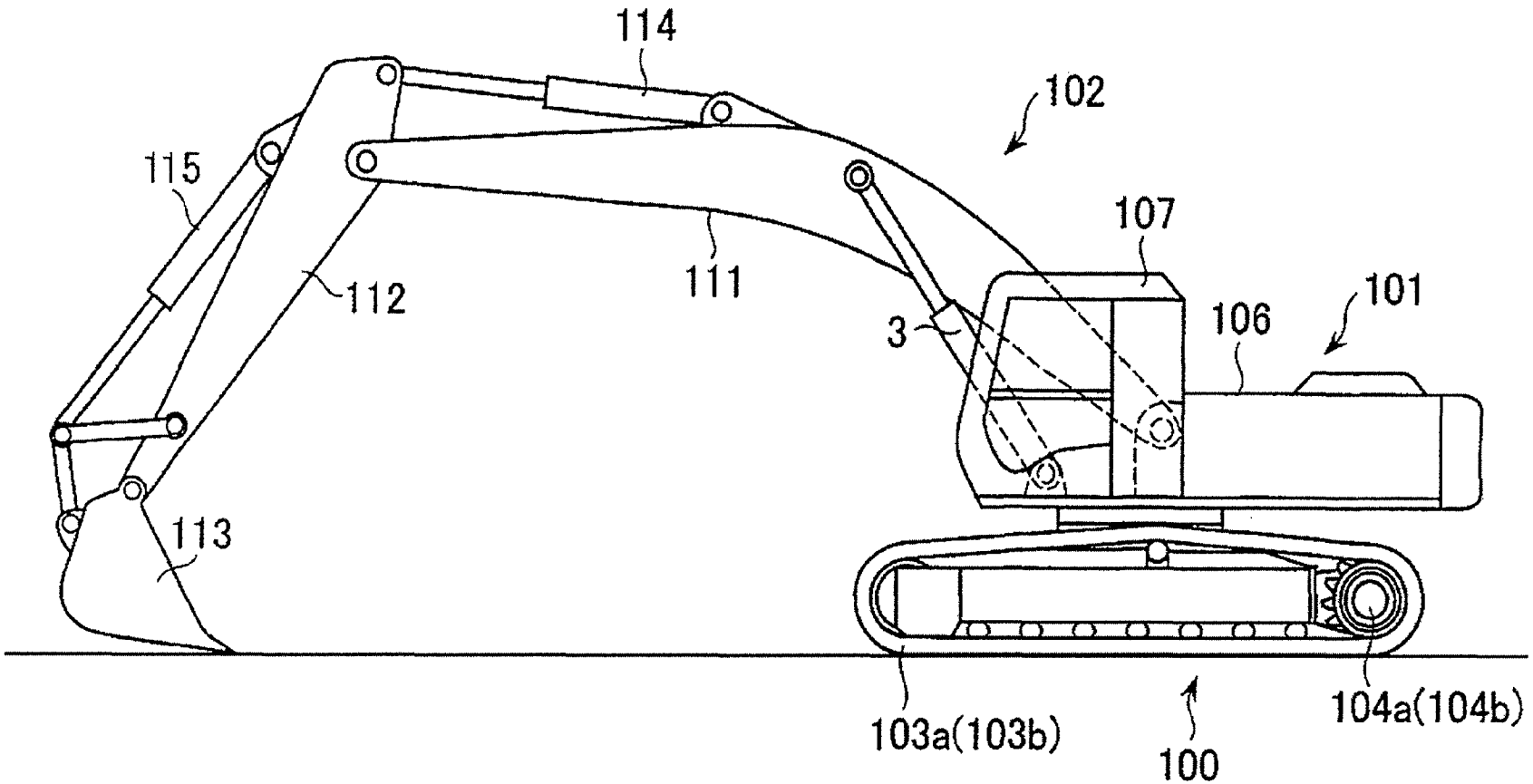
FIG. 1 is an external view of a hybrid hydraulic excavator embodying the present invention.

The first embodiment of the present invention is described below using the accompanying drawings. FIG. 1 is an external view of a hydraulic excavator (working machine) on which the hydraulic system of the present invention is mounted.

The hydraulic excavator is made up of a lower travel structure 100, an upper swing structure 101, and a front work implement 102.

The lower travel structure 100 possesses left-hand and right-hand crawler type travel devices 103*a* and 103*b* driven by left-hand and right-hand travel motors 104*a* and 104*b* respectively. The upper swing structure 101 is mounted swingably on the lower travel structure 100 and driven swingably by a swing motor (not shown). The front work implement 102 is attached elevatably to the front of the upper swing structure 101. The upper swing structure 101 is equipped with an engine room 106 and a cabin (cab) 107. The engine room 106 accommodates an engine E (to be discussed later) and such hydraulic devices as a hydraulic pump 1 and a sub-pump 8 (see FIG. 2), and the cabin 107 holds a control lever device 4 (see FIG. 2) and others. The front work implement 102 has an articulated structure equipped with a boom 111, an arm 112, and a bucket 113. The boom 111 is turned up and down by extension and contraction of a boom cylinder 3, the arm 112 is turned up and down and back and forth by extension and contraction of an arm cylinder 114, and the bucket 113 is turned up and down as well as back and forth by extension and contraction of a bucket cylinder 115.

Figure 2:
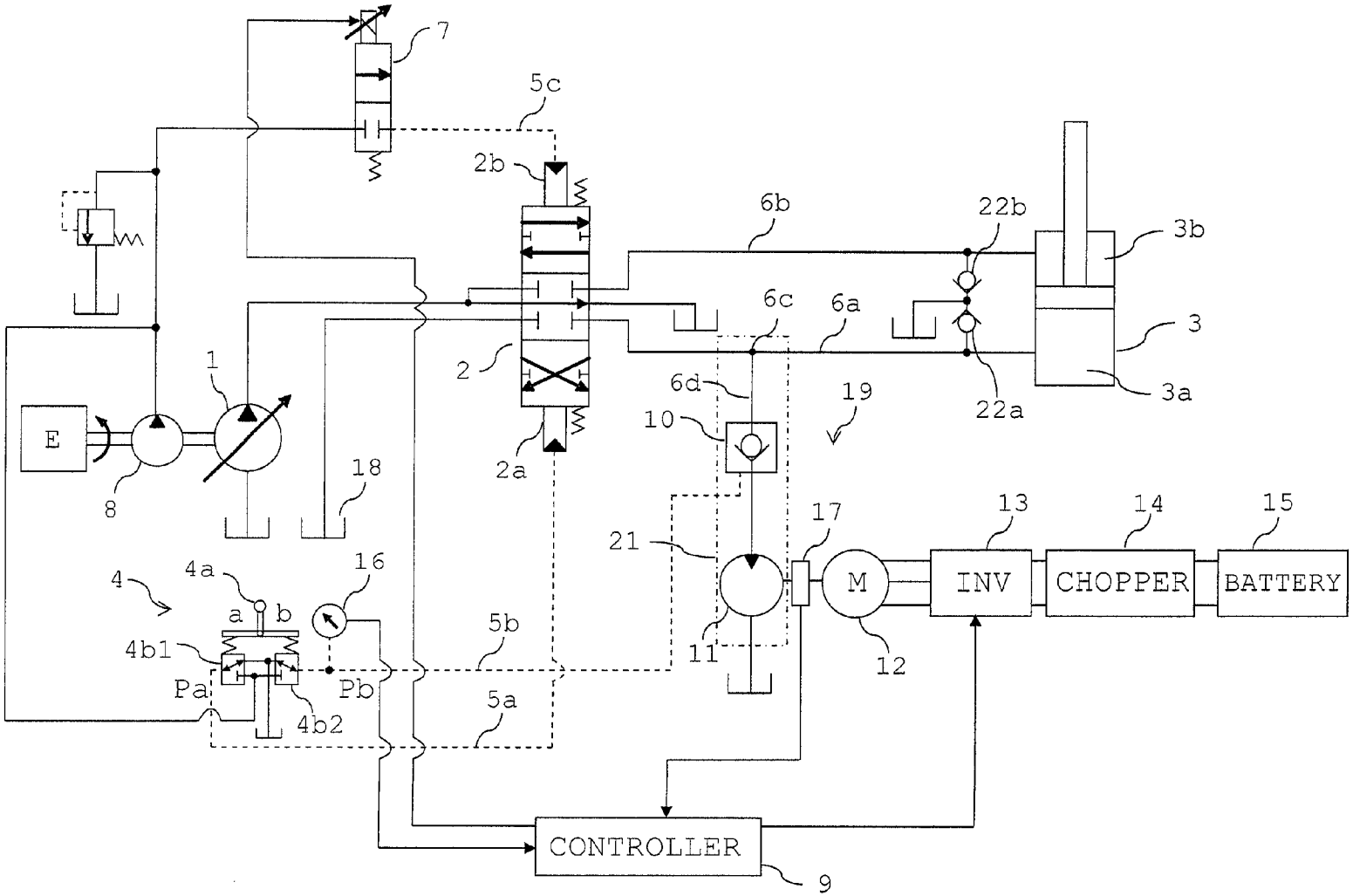
FIG. 2 is a schematic view showing part of a drive control system of the hydraulic excavator as a first embodiment of the present invention.

FIG. 2 shows a hydraulic circuit portion for driving the boom cylinder 3 and a power regeneration device built in that hydraulic circuit portion as part of the drive control system of the hydraulic excavator embodying the present invention. The same components as those in the preceding drawing are designated by the same reference numerals, and their explanations are omitted (the same also applies to the subsequent drawings).

In FIG. 2, the drive control system is made up of the hydraulic pump 1 and sub-pump 8 which are driven by the engine E, a control valve 2, the boom cylinder 3, the control lever device 4, make-up valves (supplementary valves) 22*a* and 22*b*, and a power regeneration device 19.

The hydraulic pump 1 is a main pump that supplies hydraulic fluid to the boom cylinder 3. The hydraulic line connected to the hydraulic ump 1 is fitted with a relief valve, not shown, that releases the hydraulic fluid into a tank 18 to avoid an excess buildup of the pressure inside the hydraulic line if it rises inordinately. The control valve 2 is connected to a bottom-side hydraulic chamber 3*a* and a rod-side hydraulic chamber 3*b* of the boom cylinder 3 via lines 6*a* and 6*b*. The hydraulic fluid from the hydraulic pump 1 is supplied to the bottom-side hydraulic chamber 3*a* or rod-side hydraulic chamber 3*b* of the boom cylinder through the line 6*a* or 6*b* via the control valve 2. Also, the return oil from the rod-side hydraulic chamber 3*b* of the boom cylinder 3 is recirculated to the tank 18 via the line 6*b* and control valve 2. The return oil from the bottom-side hydraulic chamber 3*a* is recirculated to the tank 18 partly through the line 6*a* and control valve 2 and mostly via a regeneration circuit 21 of the power regeneration device 19. In the ensuing description, the line 6*a* will be referred to as the bottom-side line and the line 6*b* as the rod-side line.

The control lever device 4 is furnished with the control lever 4*a* and pilot valves (reducing valves) 4*b*1 and 4*b*2. When the control lever 4*a* is tilted in the direction "a" in the drawing (boom raising operation), the pilot valve 4*b*1 outputs to a pilot hydraulic line 5*a* a pilot pressure (hydraulic signal of pressure Pa) corresponding to the amount of operation of the control lever 4*a* relative to the discharge pressure of the sub-pump 8 as the source pressure. When the control lever 4*a* is tilted in the direction "b" in the drawing (operation to lower the boom cylinder 3), the pilot valve 4*b*2 outputs to a pilot hydraulic line 5*b* a pilot pressure (hydraulic signal of pressure Pb) corresponding to the operation amount of the control lever 4*a* relative to the discharge pressure of the sub-pump 8 as the source pressure.

The control valve 2 possesses operation ports 2*a* and 2*b*. The operation port 2*a* is connected to the pilot valve 4*b*1 via the pilot hydraulic line 5*a*, and the operation port 2*b* is connected to a proportional solenoid valve 7 (to be discussed later) via a pilot hydraulic line 5*c*. In response to the pilot pressure (hydraulic signal) output to the pilot hydraulic lines 5*a* and 5*c*, control operations are carried out to switch the spool position of the control valve 2, thereby controlling the direction and the flow rate of the hydraulic fluid supplied to the boom cylinder 3.

The make-up valves 22*a* and 22*b* are provided to prevent the lines 6*a* and 6*b* from developing a negative pressure causing cavitation. When the pressure in the line 6*a* or 6*b* drops below the pressure in the tank 18, the make-up valve 22*a* or 22*b* opens to feed the hydraulic fluid to the line 6*a* or 6*b*. The make-up valve 22*b* also performs the role of supplying the rod-side hydraulic chamber 3*b* of the boom cylinder 3 with the hydraulic fluid from the tank 18 in the lowering operation of the boom 111.

The power regeneration device 19 is made up of a line 6*d*, a pilot check valve 10, a fixed displacement hydraulic motor 11, an electric motor 12, an inverter 13, a chopper 14, an electric storage device (battery) 15, a pressure sensor 16, a rotation speed sensor 17, a proportional solenoid valve 7, and a controller (control device) 9.

The line 6*d* branches from a branching portion 6*c* of the bottom-side line 6*a*. The hydraulic motor 11 is connected to the line 6*d* via the pilot check valve 10 to constitute the regeneration circuit 21. In the lowering operation of the boom 111, the return oil discharged from the bottom-side hydraulic chamber 3*a* of the boom cylinder 3 is led to the hydraulic motor 11 via the pilot check valve 10 to rotate the hydraulic motor 11, the return oil being recirculated thereafter to the tank 18.

The pilot check valve 10 is provided to prevent unnecessary flow of the hydraulic fluid from the bottom-side line 6*a* to the regeneration circuit 21 (line 6*d*) (causing the boom to fall), such as by preventing leaks of the hydraulic pressure into the regeneration circuit 21. Usually, the pilot check valve 10 keeps the regeneration circuit 21 isolated. When the operator performs an operation to lower the boom 111 (by tilting the control lever 4*a* of the control lever device 4 to the "b" side in FIG. 2), the pilot pressure (hydraulic signal of hydraulic pressure Pb) output from the pilot valve 4*b*2 is led to the pilot check valve 10 via the pilot hydraulic line 5*b*. The pilot pressure opens the pilot check valve 10 that in turn opens the regeneration circuit 21.

The electric motor 12 is coupled to the hydraulic motor 11 that generates electric power when the hydraulic motor 11 rotates. The generated electric power is stored into the electric storage device (battery) 15 via the inverter 13 and the chopper 14. The chopper 14 is a boost chopper.

The rotation speed sensor 17 is attached to the shaft coupling the hydraulic motor 11 with the electric motor 12. The rotation speed sensor 17 detects the rotation speed N (actual rotation speed) of the hydraulic motor 11 and electric motor 12.

The pressure sensor 16 is connected to the pilot hydraulic line 5*b* and detects the pilot pressure Pb output from the pilot valve 4*b*2 to the line 5*b* in the lowering operation of the boom 111. The pressure sensor 16 and rotation speed sensor 17 are connected to the controller 9, and convert the detected pilot pressure Pb and rotation speed N into electric signals that are input to the controller 9. Alternatively, the pressure sensor 16 may be replaced with a position sensor that detects the position of the control lever 4*a*.

The controller 9 accepts detection signals from the pressure sensor 16 and rotation speed sensor 17 to perform predetermined calculations, and outputs control signals accordingly to the proportional solenoid valve 7 and inverter 13.

The proportional solenoid valve 7 is activated by a control signal from the controller 9. Relative to the delivery pressure of the sub-pump 8 as the source pressure, the proportional solenoid valve 7 generates a pilot pressure designated by the control signal in question and outputs the generated pilot pressure to the pilot hydraulic line 5*c*. The pilot pressure output to the pilot hydraulic line 5*c* is led to the operation port 2*b* of the control valve 2. The opening area of the control valve 2 is adjusted in response to the pilot pressure.

Figure 3:
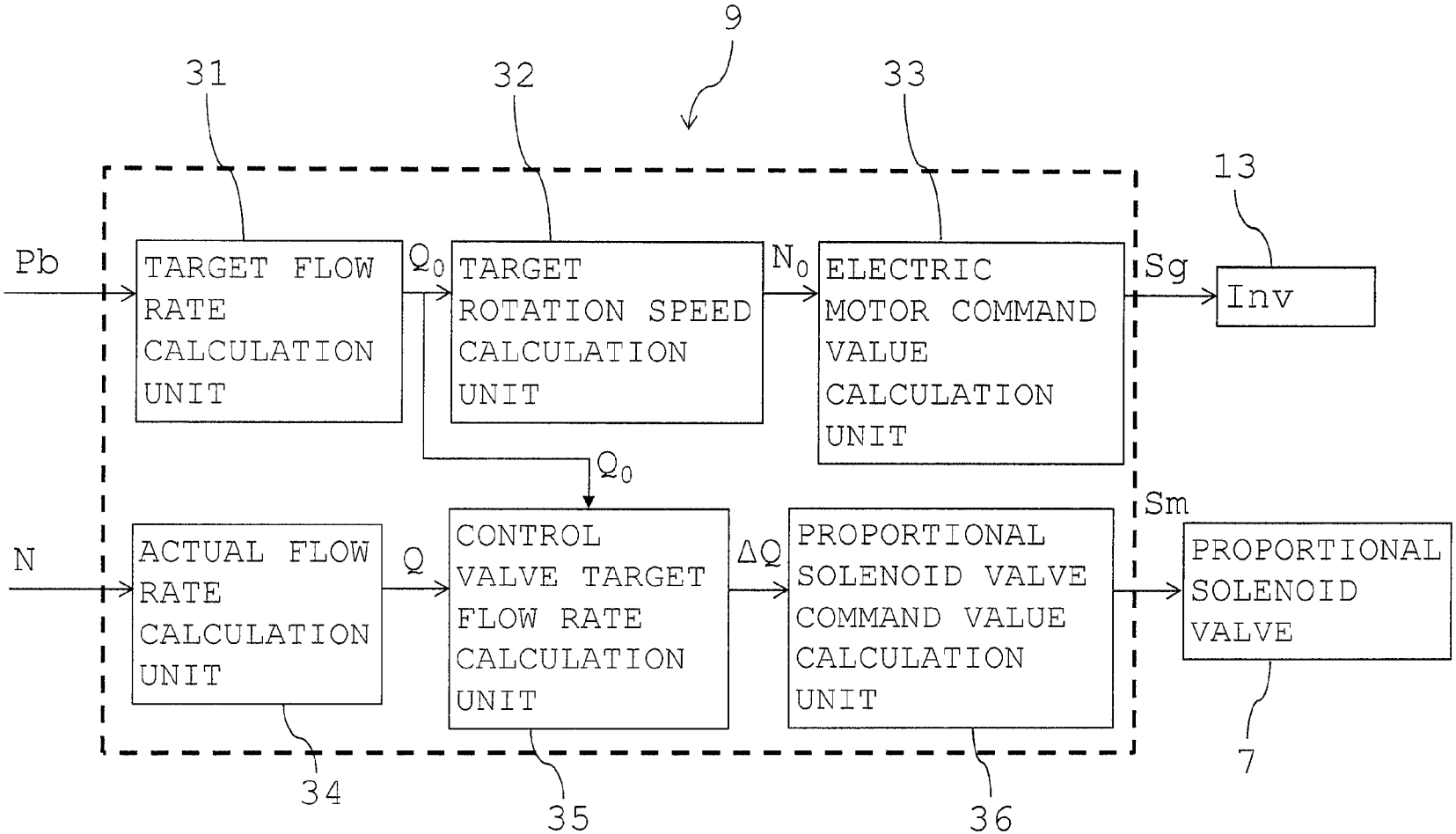
FIG. 3 is a block diagram showing a typical structure of a controller 9 associated with the first embodiment of the invention.

The control functions provided by the controller 9 are explained below with reference to FIG. 3. FIG. 3 is a block diagram depicting the control functions of the controller 9.

As shown in FIG. 3, the controller 9 has the functions represented by a target flow rate calculation unit 31, a target rotation speed calculation unit 32, an electric motor command value calculation unit 33, an actual flow rate calculation unit 34, a control valve target flow rate calculation unit 35, and a proportional solenoid valve command value calculation unit 36.

The target flow rate calculation unit 31 is a part that calculates a target flow rate $Q_0$ of the return oil discharged from the bottom-side hydraulic chamber 3*a* of the boom cylinder 3 based on the operation amount (magnitude of pilot pressure Pb) in the boom lowering direction of the control lever 4*a* ("b" side in FIG. 2). Generally, the operation amount of the control lever 4*a* in the boom lowering direction ("b" side in FIG. 2) designates the target speed of lowering of the boom 111. Given the target speed of lowering of the boom 111, the target flow rate calculation unit 31 obtains the target flow rate $Q_0$ of the return oil discharged from the bottom-side hydraulic chamber 3*a* of the boom cylinder 3. The target flow rate $Q_0$ calculated by the target flow rate calculation unit 31 is output to the target rotation speed calculation unit 32 and control valve target flow rate calculation unit 35.

Figure 4:
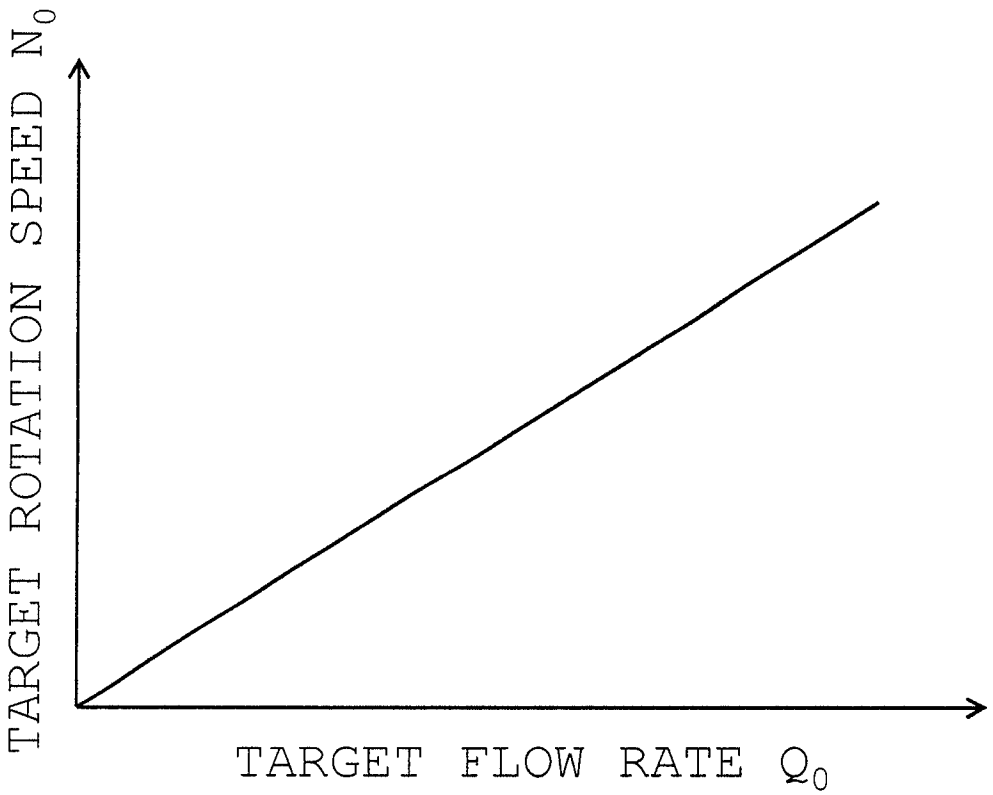
FIG. 4 is an illustration depicting the relationship between a target flow rate $Q_0$ and a target rotation speed $N_0$, stored in a target rotation speed calculation unit 32 associated with the first embodiment of the invention.

The target rotation speed calculation unit 32 is a part that obtains as a target rotation speed $N_0$ the rotation speed of the hydraulic motor 11 in effect when the entire target flow rate $Q_0$ calculated by the target flow rate calculation unit 31 passes through the hydraulic motor 11. In this case, $Q_0$ is related to $N_0$ in such a manner that $Q_0=qN_0$, where "q" denotes the delivery capacity of the hydraulic motor 11. Since the hydraulic motor 11 is a fixed displacement type, the capacity "q" is a known quantity. As shown in FIG. 4, $Q_0$ and $N_0$ are in a proportional relationship in which the target rotation speed $N_0$ increases simply in proportion to the increasing target flow rate $Q_0$. The target rotation speed $N_0$ calculated by the target rotation speed calculation unit 32 is output to the electric motor command value calculation unit 33.

The electric motor command value calculation unit 33 is a part that calculates a power generation control command value Sg for rotating the electric motor 12 in a manner that attains the target rotation speed $N_0$ calculated by the target rotation speed calculation unit 32. The command value Sg in question is output to the inverter 13. Based on the input command value Sg, the inverter 13 controls the electric motor 12 in power generation so that the rotation speed of the electric motor 12 and hydraulic motor 11 reaches the target rotation speed $N_0$.

The actual flow rate calculation unit 34 is a part that calculates the actual flow rate (passing flow rate) Q through the hydraulic motor 11 from the actual rotation speed N of the electric motor 12 detected by the rotation speed sensor 17. As with the foregoing relation between $Q_0$ and $N_0$, Q is related to N so that Q=qN, where "q" is a known quantity. Thus when N is known, Q can be obtained. The actual flow rate Q calculated by the actual flow rate calculation unit 34 is output to the control valve target flow rate calculation unit 35.

The control valve target flow rate calculation unit 35 is a part that obtains a deviation ΔQ between the target flow rate $Q_0$ calculated by the target flow rate calculation unit 31 and the actual flow rate Q calculated by the actual flow rate calculation unit 34. The deviation ΔQ represents an insufficient rate of flow which falls short of the target flow rate Q0 and which fails to reach the side of the hydraulic motor 11. As such, the deviation ΔQ is a meter-out flow rate (control valve target flow rate) that should flow through the control valve 2. The flow rate deviation ΔQ calculated by the control valve target flow rate calculation unit 35 is output to the proportional solenoid valve command value calculation unit 36 as the control valve target flow rate ΔQ.

The proportional solenoid valve command value calculation unit 36 is a part that calculates a command value Sm for controlling the opening area of the proportional solenoid valve 7 to introduce the pilot pressure into the operation portion 2*b* of the control valve 2 in such a manner that the hydraulic fluid is allowed to flow through the control valve 2 in just as much as the control valve target flow rate ΔQ calculated by the control valve target flow rate calculation unit 35. The command value Sm in question is output to the proportional solenoid valve 7.

Incidentally, there may be provided beforehand a table that defines the relationship between the operation amount of the control lever 4*a* and the target flow rate $Q_0$, the relationship between the target flow rate $Q_0$ and the target rotation speed $N_0$, the relationship between the target rotation speed $N_0$ and the power generation control command value Sg, the relationship between the actual rotation speed N and the actual flow rate Q, and the relationship between the control valve target flow rate ΔQ and the opening area of the control valve 2, the values being calculated by the respective calculation units.

In FIG. 3, the target flow rate calculation unit 31 obtains the target flow rate $Q_0$ of the hydraulic motor 11; the actual flow rate calculation unit 34 obtains the actual flow rate Q of the hydraulic motor 11; and the control valve target flow rate calculation unit 35 calculates the deviation ΔQ between the target flow rate $Q_0$ and the actual flow rate Q and uses the calculated deviation as the control valve target flow rate ΔQ. Alternatively, the control valve target flow rate ΔQ may be obtained from $N_0$ acquired by the target rotation speed calculation unit 32 and from N detected by the rotation speed sensor 17.

Figure 5:
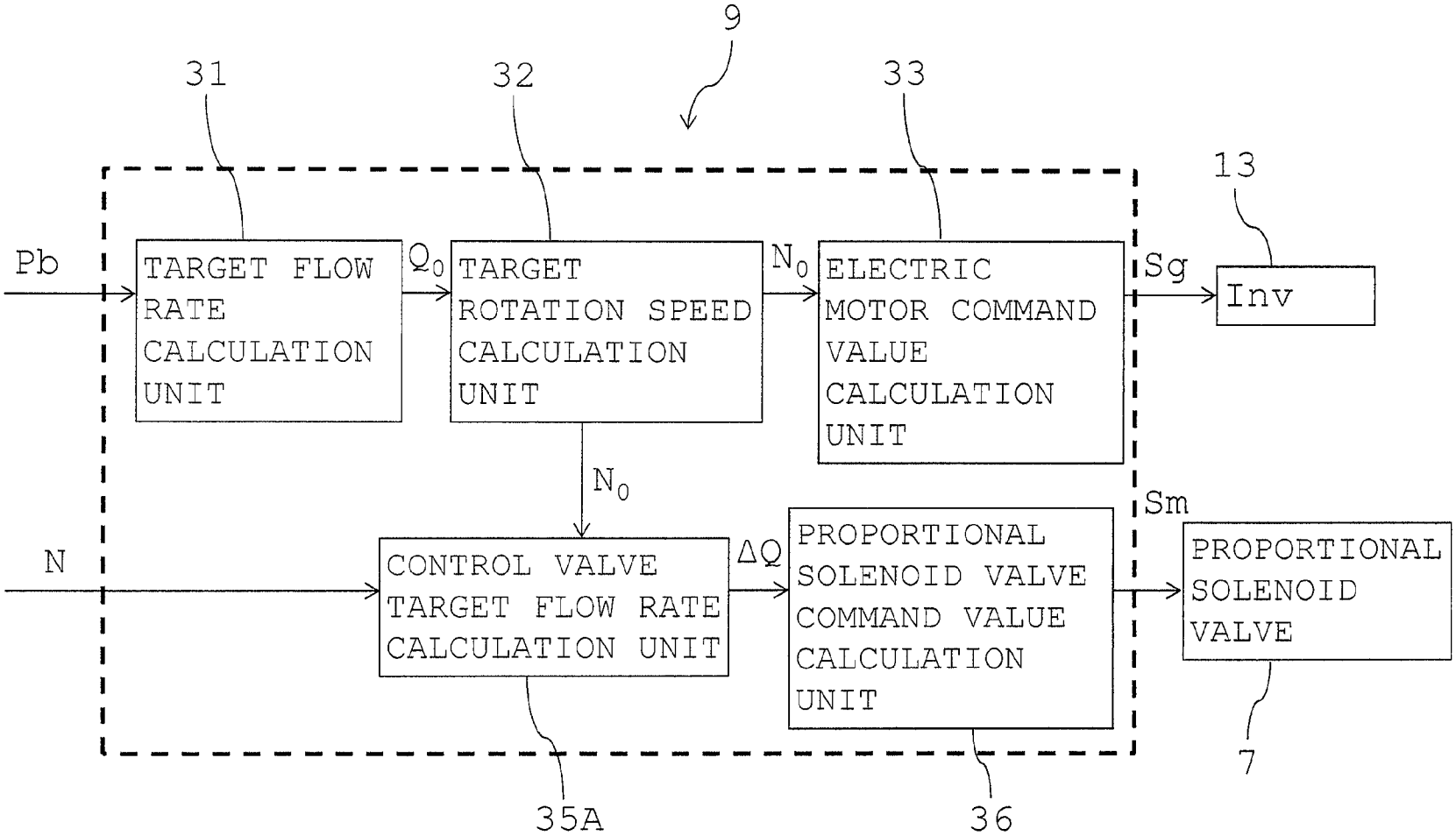
FIG. 5 is a block diagram showing an alternative structure of the controller 9 associated with the first embodiment of the invention.

This alternative example is shown in FIG. 5. The target rotation speed $N_0$ calculated by the target rotation speed calculation unit 32 is output to the electric motor command value calculation unit 33 and to a control valve target flow rate calculation unit 35A. From the target rotation speed $N_0$ and from the actual rotation speed N of the electric motor 12 detected by the rotation speed sensor 17, the control valve target flow rate calculation unit 35A calculates $\Delta Q=q(N_0-N)$ to obtain the flow rate deviation ΔQ. The control valve target flow rate calculation unit 35A outputs this flow rate deviation ΔQ to the proportional solenoid valve command value calculation unit 36 as the control valve target flow rate.

The movements of this embodiment are explained next.

The raising operation of the boom 111 (extension of the boom cylinder 3) is explained first.

When the control lever 4*a* is operated toward the "a" side in FIG. 2, the pilot pressure Pa is transmitted from the pilot valve 4*b*1 to the operation port 2*a* of the control valve 2 via the pilot hydraulic line 5*a*. This switches the control valve 2 to feed the hydraulic fluid from the hydraulic pump 1 to the bottom-side hydraulic chamber 3*a* of the boom cylinder 3 via the bottom-side line 6*a* so that the boom cylinder 3 is extended (the boom 111 is turned upward). At the same time, the return oil discharged from the rod-side hydraulic chamber 3*b* of the boom cylinder 3 is recirculated to the tank 18 via the rod-side line 6*b* and control valve 2. At this point, no operating pilot pressure is led to the pilot check valve 10 so that the regeneration circuit 21 of the power regeneration device 19 attached to the bottom-side line 6*a* is in an isolated state and does not perform regeneration operation.

The lowering operation of the boom 111 (contraction of the boom cylinder 3) is explained next.

When the control lever 4*a* is operated toward the "b" side in FIG. 2, the pilot pressure Pb from the pilot valve 4*b*2 is led to the pilot check valve 10 via the pilot hydraulic line 5*b*, causing the pilot check valve 10 to open.

At this point, the deadweight of the front work implement 102 including the boom 111 pushes the boom cylinder 3 to discharge the hydraulic fluid within the bottom-side hydraulic chamber 3*a* of the boom cylinder 3 into the line 6*a*. Because the pilot check valve 10 is currently open, the regeneration circuit 21 of the power regeneration device 19 is held open. The discharged hydraulic fluid is evacuated into the tank 18 via the line 6*d* and pilot check valve 10 past the hydraulic motor 11.

Also, the hydraulic fluid is supplied from the tank 18 to the rod-side hydraulic chamber 3*b* of the boom cylinder 3 via the make-up valve 22*b* so as to prevent a negative pressure from developing inside the rod-side line 6*b* when the boom cylinder 3 is pushed by the deadweight of the front work implement 102.

This causes the boom cylinder 3 to contract and the boom 111 to start being lowered.

The hydraulic motor 11 is rotated by the return oil flowing thereto. The electric motor 12 coupled directly to the hydraulic Motor 11 is thus rotated to perform a power generation operation. The generated electric energy is stored into the battery 15, whereby the power regeneration operation is carried out.

At the same time, an electric signal corresponding to the pilot pressure Pb is input to the controller 9. Based on the operation amount of the control lever 4*a* thus input, the target flow rate calculation unit 31 calculates the target flow rate $Q_0$ of the hydraulic motor 11. The target rotation speed calculation unit 32 calculates the target rotation speed $N_0$ of the electric motor 12 from the target flow rate $Q_0$. The electric motor command value calculation unit 33 calculates the power generation control command value Sg to the inverter 13 from the target rotation speed $N_0$. Given the input actual rotation speed N of the hydraulic motor 11, the actual flow rate calculation unit 34 calculates the actual flow rate Q flowing through the hydraulic motor 11. The control valve target flow rate calculation unit 35 calculates an insufficient flow rate ΔQ from the target flow rate $Q_0$ and actual flow rate Q. Thereafter, given the insufficient flow rate ΔQ, the proportional solenoid valve command value calculation unit 36 calculates the command value Sm for controlling the opening area of the proportional solenoid valve 7.

The control command value Sm is output to the proportional solenoid valve 7. Based on the input control command value Sm, the proportional solenoid valve 7 has its opening area adjusted to control the operation pilot pressure supplied from the sub-pump 8. Controlled as desired in this manner, the operation pilot pressure is led to the operation port 2*b* of the control valve 2 via the pilot hydraulic line 5*c*. The hydraulic fluid is controlled to flow to the control valve 2 just in the amount of ΔQ. The hydraulic fluid in the amount of ΔQ is therefore supplied from the hydraulic pump 1 to the rod-side hydraulic chamber 3*b* of the boom cylinder 3, and the hydraulic fluid in the amount of ΔQ from the bottom-side hydraulic chamber 3*a* of the boom cylinder 3 is discharged into the tank 18 via the control valve 2.

At the same time, the power generation control command value Sg is output to the inverter 13. Based on the input power generation control command value Sg, the inverter 13 controls the electric motor 12 in power generation in such a manner that the rotation speed of the electric motor 12 attains the target rotation speed $N_0$, that the electric motor 12 and hydraulic motor 11 rotate at the target rotation speed $N_0$, and that the flow rate of the hydraulic fluid flowing through the hydraulic motor 11 coincides with the target flow rate $Q_0$, whereby the above-described power regeneration operation is carried out.

Figure 6:
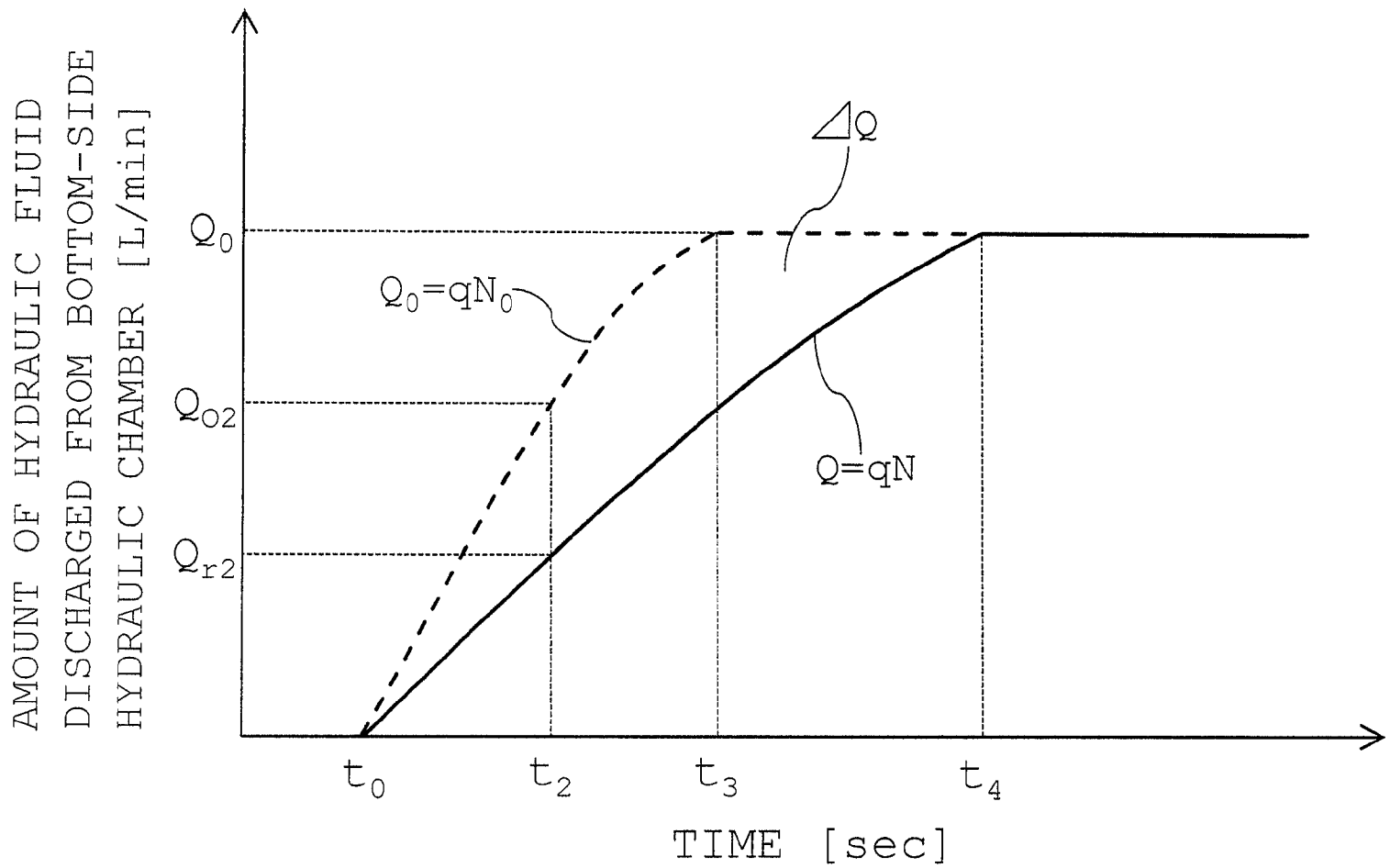
FIG. 6 is an illustration depicting the relationship between an actual flow rate Q and the target flow rate $Q_0$, relative to an operation start time at which a control lever 4*a* starts to be operated on the first embodiment of the invention.

FIG. 6 is an illustration depicting the relationship between the actual flow rate Q and the target flow rate $Q_0$ relative to an operation start time at which the control lever 4*a* starts to be operated.

It is assumed that a lowering operation of the boom 111 starts at time $t_0$. In this case, as shown in FIG. 6, an attempt is made to control the amount of the hydraulic fluid discharged from the bottom-side hydraulic chamber 3*a* of the boom cylinder 3 to be the target flow rate $Q_0$ (dotted line curve) corresponding to the target rotation speed $N_0$. However, because the delivery capacity q of the hydraulic motor 11 is fixed, it takes time for the actual rotation speed N to coincide with the target rotation speed $N_0$. When the boom cylinder 3 starts to move, the actual flow rate Q (solid line curve) flowing through the hydraulic motor 11 does not coincide with the target flow rate $Q_0$, so that a flow rate difference ΔQ develops between the target flow rate ($Q_0$) and the actual flow rate (Q)(a deviation between $Q_0$ and Q). For example, at a given time $t_2$ relative to the start of the operation, the target flow rate that should flow through the hydraulic motor 11 is $Q_{02}$ which does not coincide with an actual flow rate $Q_{r2}$ flowing through the hydraulic motor 11. Whereas an ideal time is $t_3$ required for the hydraulic motor 11 to rotate so that the amount of the hydraulic fluid discharged from the bottom-side hydraulic chamber 3*a* would attain the target flow rate $Q_0$, the actual time required is $t_4$.

Thus in order to get the boom 111 starting to move smoothly, it is necessary to control the opening area of the control valve 2 to let the hydraulic fluid flow therethrough in the amount of the flow rate difference ΔQ so that the hydraulic fluid may be discharged from the bottom-side hydraulic chamber 3*a* into the tank 18 via the control valve 2.

Thus based on the electric signal reflecting the input operation amount of the control lever 4*a* and on the actual rotation speed of the hydraulic motor 11, the controller 9 calculates the power generation control command value Sg to the inverter 13 and the command value Sm to the proportional solenoid valve 7. Upon receipt of the power generation control command value Sg thus calculated, the inverter 13 controls the electric motor 12 in power generation so that the motor rotation speed will attain the target rotation speed $N_0$. On receiving the command value Sm, the proportional solenoid valve 7 adjusts its opening area to control the operation pilot pressure fed from the sub-pump 8 so that the hydraulic fluid will flow to the control value 2 in just as much as the amount of ΔQ.

As described, whereas it takes time $t_4$ for the amount of the hydraulic fluid discharged from the bottom-side hydraulic chamber 3*a* to attain the target flow rate $Q_0$ if the boom 111 is lowered by getting the hydraulic fluid to flow only to the power regeneration device 19 as in conventional cases, this embodiment allows the hydraulic fluid to be evacuated in the amount corresponding to ΔQ from the bottom-side hydraulic chamber 3*a* of the boom cylinder 3 into the tank 18. As a result, it takes time $t_3$ for the amount of the hydraulic fluid discharged from the bottom-side hydraulic chamber 3*a* to reach the target flow rate $Q_0$, the time t3 being shorter.

The boom cylinder 3 is thus moved smoothly in the contracting operation (the boom 111 is turned downward) in keeping with the operator's boom lowering operation.

With the above-described structures and workings in effect, when the operator performs an operation to lower the boom 111, the amount of the return oil from the boom cylinder 3 is controlled to be the target flow rate. This guarantees the responsiveness of the boom cylinder 3 in response to the operator's operations and keeps the boom cylinder 3 starting to move smoothly. Because there is no need to let any more hydraulic fluid than is necessary flow to the control valve 2, the power regeneration device 19 is allowed to maintain its good power regeneration efficiency.

Second Embodiment

Figure 7:
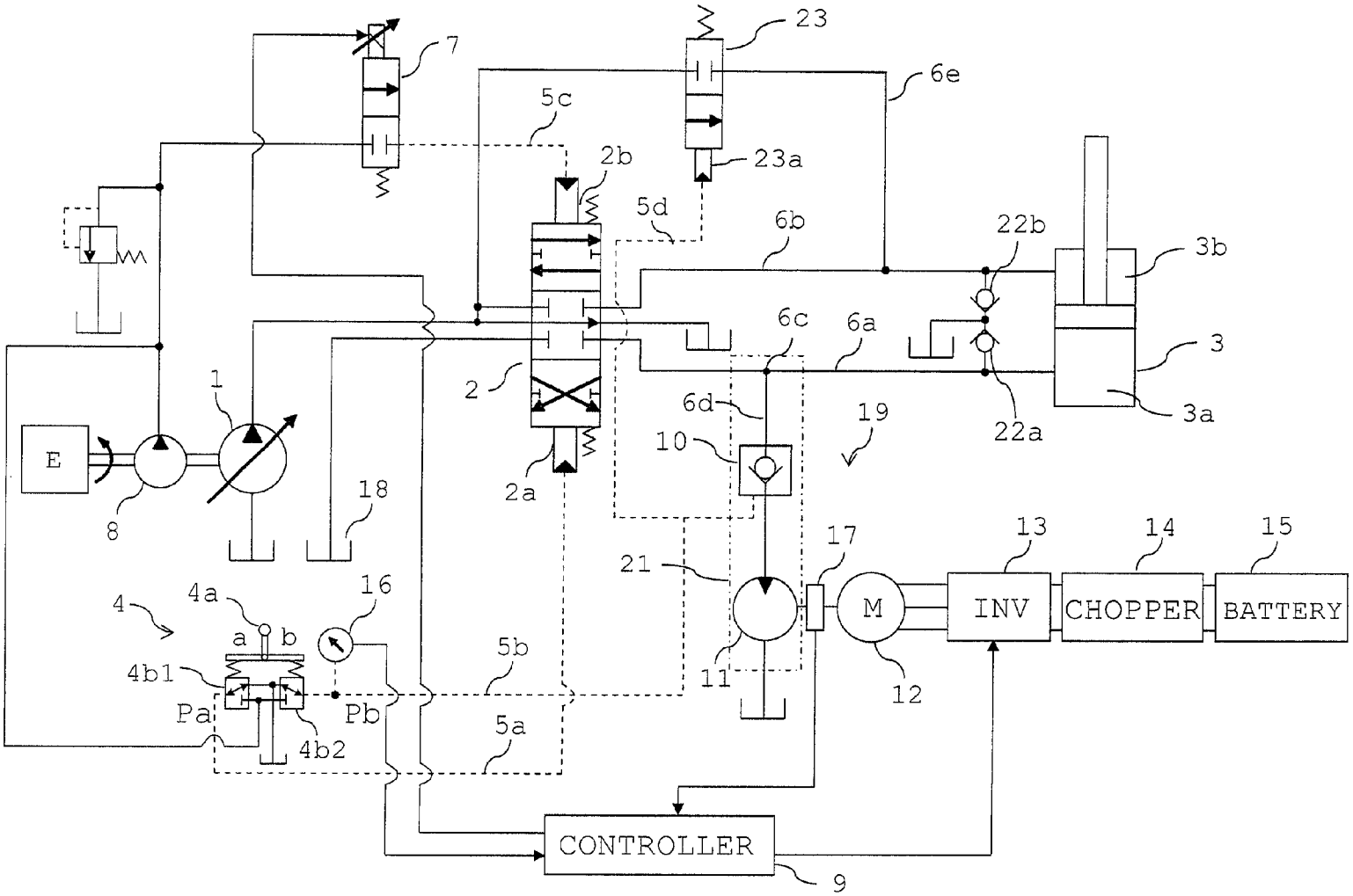
FIG. 7 is a schematic view showing part of a drive control system of a hydraulic excavator as a second embodiment of the present invention.

A hybrid hydraulic excavator as the second embodiment of the present invention is explained below. FIG. 7 is similar to FIG. 2, showing a hydraulic circuit portion for driving the boom cylinder 3 and a power regeneration device built in that hydraulic circuit portion as part of the drive control system of the hydraulic excavator embodying the present invention.

As with the drive control system in FIG. 2, the drive control system in FIG. 7 includes a hydraulic pump 1 and a sub-pump 8 which are driven by the engine E, a control valve 2, a boom cylinder 3, a control lever device 4, and a power regeneration device 19. The drive control system of this embodiment is further equipped with an on-off valve 23 interposed between the hydraulic pump 1 and the line 6*b* and connected in parallel with the control valve 2.

The on-off valve 23 has an operation port 23*a* that is connected to a pilot valve 4*b*2 via pilot hydraulic lines 5*d* and 5*b*. The on-off valve 23 is usually in the closed position and switched to the opened position in response to the pilot pressure Pb output to the pilot hydraulic lines 5*b* and 5*d*. This allows the hydraulic pump 1 to supply the hydraulic fluid to the rod-side hydraulic chamber 3*b* of the boom cylinder 3 via the lines 6*e* and 6*b*.

The movements of this embodiment are explained below.

The raising operation of the boom 111 with this embodiment is substantially the same as with the first embodiment and thus will not be discussed further. Only the lowering operation of the boom 111 with this embodiment will be explained hereunder.

When the control lever 4*a* is operated toward the "b" side in FIG. 7, the pilot pressure Pb is led from the pilot valve 4*b*2 to the pilot check valve 10 via the pilot hydraulic line 5*b*, causing the pilot check valve 10 to open.

At this point, the boom cylinder 3 is pushed by the deadweight of the front work implement 102 including the boom 111 so that the hydraulic fluid in the bottom-side hydraulic chamber 3*a* of the boom cylinder 3 is discharged into the line 6*a*. Because the pilot check valve 10 is currently open, the regeneration circuit 21 of the power regeneration device 19 is held open. The discharged hydraulic fluid is evacuated into the tank 18 via the line 6*d* and pilot check valve 10 past the hydraulic motor 11. At the same time, the pilot pressure Pb from the pilot valve 4*b*2 is led to the operation port 23*a* of the on-off valve 23 via the pilot hydraulic line 5*d*. This switches the on-off valve 23 to the opened position, allowing the hydraulic fluid to be supplied from the hydraulic pump 1 to the rod-side hydraulic chamber 3*b* of the boom cylinder 3 via the hydraulic lines 6*e* and 6*b*. As a result, the rod-side hydraulic chamber 3*b* of the boom cylinder 3 is supplied positively with the hydraulic fluid from the hydraulic pump 1 via the on-off valve 23, which causes the boom cylinder 3 to contract rapidly and the boom 111 to start descending smoothly.

The hydraulic motor 11 is rotated by the return oil discharged from the boom cylinder 3, causing the electric motor 12 directly coupled with the hydraulic motor 11 to perform a power generation operation. The generated electric power is stored into the battery 15, whereby the power regeneration operation is carried out.

As with the first embodiment, a control signal from the controller 9 controls the opening area of the proportional solenoid valve 7 to switch the control valve 2.

With this embodiment structured as described above, the flow rate of the return oil from boom cylinder 3 is controlled to be the target flow rate, and the on-off valve 23 is further provided interposingly between the hydraulic pump 1 and the line 6*b*. This allows the hydraulic fluid from the hydraulic pump 1 to be fed to the rod-side hydraulic chamber 3*b* of the boom cylinder 3, thereby providing better responsiveness of the boom cylinder 3 in the lowering operation in response to the operator's operations. Also with this embodiment, there is no need for feeding any more hydraulic fluid than is necessary to the control valve 2, which permits the power regeneration device 19 to maintain excellent efficiency in power regeneration.

<Others>

Whereas the above embodiments were explained by referring to cases where the boom cylinder is used as the hydraulic cylinder, this embodiment can also be applied to the arm cylinder or others. In the latter case, the same advantages offered by the above embodiments are also provided. Furthermore, although cases where the electric motor is driven as a generator were explained, the position of the electric motor may be occupied alternatively by a power generator that only performs power generation operation.

In addition, although the hydraulic excavator was explained above as a typical working machine, the present invention is not limited to the hydraulic excavator serving as the working machine. This invention may also be applied to working machines equipped with hydraulic actuators driving a work implement, such as a forklift or a wheel loader. In these cases, too, the present invention provides advantages similar to those discussed above.

DESCRIPTION OF REFERENCE CHARACTERS

1 Hydraulic pump
2 Control valve
3 Boom cylinder
3*a* Bottom-side hydraulic chamber
3*b* Rod-side hydraulic chamber
4 Control lever device
4*a* Control lever
4*b* Pilot valve
5*a*, 5*b*, 5*c* Pilot hydraulic line
6*a*, 6*b*, 6*e* Hydraulic line
6*c* Branching portion
6*d* Branching line
7 Proportional solenoid valve
8 Sub-pump
9 Controller
10 Pilot check valve
11 Hydraulic motor
12 Electric motor
13 Inverter
14 Chopper
15 Electric storage device (battery)
16 Pressure sensor
17 Rotation speed sensor
18 Tank
19 Power regeneration device
21 Regeneration circuit
22*a*, 22*b* Make-up valve
23 On-off valve
23*a* Operation port
31 Target flow rate calculation unit
32 Target rotation speed calculation unit
33 Electric motor command value calculation unit
34 Actual flow rate calculation unit
35, 35A Control valve target flow rate calculation unit
36 Proportional solenoid valve command value calculation unit
100 Lower travel structure
101 Upper swing structure
102 Front work implement
103*a* Travel device
104*a* Travel motor
106 Engine room
107 Cab (cabin)
111 Boom
112 Arm
113 Bucket
114 Arm cylinder
115 Bucket cylinder
E Engine
N Actual rotation speed
$N_0$ Target rotation speed
$Q_0$ Target flow rate
$\Delta Q$ Insufficient flow rate

The invention claimed is:

1. A power regeneration device for a working machine equipped with a hydraulic actuator for driving a work device, a control valve for operating and controlling the hydraulic actuator, and a control lever device with a control lever for operating the control valve to activate the hydraulic actuator, the power regeneration device comprising:

a hydraulic motor driven by return oil from the hydraulic actuator;

an electric motor connected mechanically to the hydraulic motor and driven thereby to generate electric power;

an inverter which controls the rotation speed of the electric motor, and an electric storage device which stores the electric power generated by the electric motor;

wherein the return oil discharged from the hydraulic actuator is branched and distributed to the side of the control valve and that of the hydraulic motor, the power regeneration device further comprising:

a rotation speed detector which detects an actual rotation speed of the electric motor;

an operation amount detector which detects the amount of operation of the control lever;

a proportional solenoid valve which adjusts the opening area of the control valve, and a control device to which the rotation speed detected by the rotation speed detector and the operation amount detected by the operation amount detector are input;

wherein the control device obtains a target flow rate of the return oil discharged from the hydraulic actuator and a target rotation speed of the electric motor based on the operation amount to control the rotation speed of the electric motor via the inverter in a manner attaining the target rotation speed of the electric motor, and obtains a deviation between the target flow rate and the actual flow rate of hydraulic fluid passing through the electric motor based on the target flow rate and on the actual rotation speed of the electric motor detected by the rotation speed detector, and controls the proportional solenoid valve based on the deviation obtained.

2. The power regeneration device for a working machine according to claim 1, wherein the control device includes:

a target flow rate calculation unit which receives the operation amount and obtains the target flow rate based on the received operation amount;

a target rotation speed calculation unit which obtains the target rotation speed from the target flow rate obtained;

an electric motor command value calculation unit which obtains an inverter control signal for the inverter from the target rotation speed obtained;

an actual flow rate calculation unit which receives the actual rotation speed and obtains the actual flow rate based on the received actual rotation speed;

a control valve target flow rate calculation unit (35) which obtains the deviation from the actual flow rate and the target flow rate and provides the deviation obtained as a target flow rate for the control valve; and a proportional solenoid valve command value calculation unit which obtains a control signal for the proportional solenoid valve from the control valve target flow rate obtained.

3. The power regeneration device for a working machine according to claim 1, wherein the control device includes:

a target flow rate calculation unit which receives the operation amount and obtains the target flow rate based on the received operation amount;

a target rotation speed calculation unit which obtains the target rotation speed from the target flow rate obtained;

an electric motor command value calculation unit which obtains an inverter control signal for the inverter from the target rotation speed obtained;

a control valve target flow rate calculation unit which receives the actual rotation speed, obtains a deviation between the target flow rate and the actual flow rate from a deviation between the target rotation speed obtained by the target rotation speed calculation unit and the actual rotation speed, and provides the deviation obtained as a target flow rate for the control valve; and a proportional solenoid valve command value calculation unit which obtains a control signal for the proportional solenoid valve from the control valve target flow rate obtained.

4. The power regeneration device for a working machine according to claim 1, further comprising an on-off valve which is connected in parallel with the control valve, and interposed between the hydraulic pump and the hydraulic fluid supply side of the hydraulic actuator and which is switched to the opened position when the control lever of the control lever device is operated.

5. A working machine furnished with a power regeneration device for a working machine according to claim 1.

6. The power regeneration device for a working machine according to claim 2, further comprising an on-off valve which is connected in parallel with the control valve, and interposed between the hydraulic pump and the hydraulic fluid supply side of the hydraulic actuator and which is switched to the opened position when the control lever of the control lever device is operated.

7. The power regeneration device for a working machine according to claim 3, further comprising an on-off valve which is connected in parallel with the control valve, and interposed between the hydraulic pump and the hydraulic fluid supply side of the hydraulic actuator and which is switched to the opened position when the control lever of the control lever device is operated.

8. A working machine furnished with a power regeneration device for a working machine according to claim 2.

9. A working machine furnished with a power regeneration device for a working machine according to claim 3.

10. A working machine furnished with a power regeneration device for a working machine according to claim 4.

11. A working machine furnished with a power regeneration device for a working machine according to claim 5.

12. A working machine furnished with a power regeneration device for a working machine according to claim 6.

* * * * *